US009849340B2

(12) United States Patent
Mimura et al.

(10) Patent No.: US 9,849,340 B2
(45) Date of Patent: Dec. 26, 2017

(54) GOLF BALL

(71) Applicant: DUNLOP SPORTS CO. LTD., Kobe-shi, Hyogo (JP)

(72) Inventors: Kohei Mimura, Kobe (JP); Takahiro Sajima, Kobe (JP); Hyoungchol Kim, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 29 days.

(21) Appl. No.: 14/856,721

(22) Filed: Sep. 17, 2015

(65) Prior Publication Data

US 2016/0096076 A1 Apr. 7, 2016

(30) Foreign Application Priority Data

Oct. 2, 2014 (JP) ..... 2014-203655

(51) Int. Cl.
*A63B 37/06* (2006.01)
*A63B 37/00* (2006.01)

(52) U.S. Cl.
CPC ..... *A63B 37/0006* (2013.01); *A63B 37/0009* (2013.01); *A63B 37/0017* (2013.01); *A63B 37/0018* (2013.01); *A63B 37/0019* (2013.01); *A63B 37/0075* (2013.01)

(58) Field of Classification Search
CPC ..... A63B 37/0006; A63B 37/0007
USPC ..... 473/381
See application file for complete search history.

(56) References Cited

U.S. PATENT DOCUMENTS

| | | | | |
|---|---|---|---|---|
| 5,078,402 | A | 1/1992 | Oka | |
| 6,991,564 | B2 * | 1/2006 | Sajima | A63B 37/0004 473/383 |
| 9,486,672 | B2 * | 11/2016 | Kim | G06F 17/50 |
| 2006/0172824 | A1 * | 8/2006 | Nardacci | A63B 37/0006 473/378 |
| 2009/0298618 | A1 * | 12/2009 | Kim | A63B 37/0007 473/378 |
| 2012/0004053 | A1 * | 1/2012 | Kim | A63B 37/0006 473/379 |
| 2012/0277032 | A1 * | 11/2012 | Sato | A63B 37/0003 473/379 |
| 2013/0005510 | A1 * | 1/2013 | Kim | G06F 17/50 473/384 |

* cited by examiner

*Primary Examiner* — Raeann Gorden
(74) *Attorney, Agent, or Firm* — Birch, Stewart, Kolasch & Birch, LLP

(57) ABSTRACT

A golf ball 2 has a large number of dimples 10 on a surface thereof. The contours of the dimples 10 are non-circular. A standard deviation of areas of the dimples 10 is equal to or less than 1.7 $mm^2$. A ratio of a total area of the dimples 10 relative to a surface area of a phantom sphere of the golf ball 2 is equal to or greater than 80%. By comparting lines CS obtained by projecting sides of a regular dodecahedron, which is inscribed in the phantom sphere, onto the phantom sphere, a surface of the phantom sphere can be divided into 12 units Ut each of which meets the following mathematical formula (I):

$$-2 \leq (Nt/12) - Nu \leq 2 \quad \text{(I)},$$

where Nt represents the total number of the dimples 10 and Nu represents the number of the dimples 10 on one unit.

4 Claims, 23 Drawing Sheets

GOLF BALL

This application claims priority on Patent Application No. 2014-203655 filed in JAPAN on Oct. 2, 2014. The entire contents of this Japanese Patent Application are hereby incorporated by reference.

BACKGROUND OF THE INVENTION

Field of the Invention

The present invention relates to golf balls. Specifically, the present invention relates to improvement of aerodynamic characteristics of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

A polyhedron is used for arranging dimples. The polyhedron is inscribed in the phantom sphere of a golf ball. A large number of sides of the polyhedron are projected onto the surface of the phantom sphere by light that travels from the center of the phantom sphere in the radial direction. By this projection, a large number of comparting lines are obtained on the surface of the phantom sphere. By these comparting lines, the surface of the phantom sphere is divided into a large number of units (spherical polygons). A large number of dimples are arranged on one unit to obtain a dimple pattern. The dimple pattern is developed to the other units to obtain a dimple pattern of the entire golf ball. The dimple pattern is referred to as polyhedron pattern. The polyhedron pattern has a large number of symmetric axes. A golf ball having a polyhedron pattern is disclosed in JPH1-221182 (U.S. Pat. No. 5,078,402).

A dimple pattern referred to as hemisphere division pattern is used in commercial golf balls. In designing of this pattern, first, a hemisphere (a half of a phantom sphere) is divided into a plurality of units by a plurality of longitude lines. The shape of each unit is a spherical isosceles triangle. A large number of dimples are arranged on one unit to obtain a dimple pattern. The dimple pattern is developed to the other units. The development is achieved by rotating one unit pattern about a line passing through the north pole and the south pole. By this rotation, a dimple pattern of the entire golf ball is obtained. The pattern of the golf ball is rotationally symmetrical.

JP2013-9906 (US2013/0005510) discloses a golf ball having dimples which are randomly arranged. The contour shape of each dimple is non-circular. In the golf ball, the ratio of the total area of the dimples relative to the surface area of the phantom sphere of the golf ball is high. This ratio is referred to as occupation ratio. The flight distance performance of the golf ball correlates with the occupation ratio. The golf ball has excellent flight distance performance.

In the polyhedron pattern, the arrangement of the dimples is constrained by the comparting lines. In the polyhedron pattern, the dimples are less likely to be densely arranged. The flight distance performance of a golf ball having a polyhedron pattern is not sufficient.

In the hemisphere division pattern, the distribution of the dimples is ununiform. Therefore, the aerodynamic symmetry of a golf ball having a hemisphere division pattern is not sufficient.

The golf ball disclosed in JP2013-9906 also has inferior aerodynamic symmetry.

An object of the present invention is to provide a golf ball having excellent flight distance performance and aerodynamic symmetry.

SUMMARY OF THE INVENTION

A golf ball according to the present invention has a large number of dimples on a surface thereof. A standard deviation of areas of the dimples is equal to or less than 1.7 $mm^2$. A ratio of a total area of the dimples relative to a surface area of a phantom sphere of the golf ball is equal to or greater than 80%. The dimples include a dimple having a non-circular contour. By comparting lines obtained by projecting sides of a regular dodecahedron, which is inscribed in the phantom sphere, onto the phantom sphere, a surface of the phantom sphere can be divided into 12 units each of which meets the following mathematical formula (I):

$$-2 \leq (Nt/12) - Nu \leq 2 \quad \text{(I)},$$

where Nt represents a total number of the dimples and Nu represents a number of the dimples on one unit.

In the golf ball according to the present invention, both a high occupation ratio and a low standard deviation are achieved. Therefore, the golf ball has excellent flight distance performance. The golf ball meets the mathematical formula (I). Therefore, the golf ball also has excellent aerodynamic symmetry.

Each dimple preferably has a contour shape different from those of any other dimples.

Preferably, a total volume of the dimples is equal to or greater than 520 $mm^3$ but equal to or less than 720 $mm^3$. Preferably, the total number Nt of the dimples is equal to or greater than 300 but equal to or less than 450.

A process for designing a dimple pattern on a golf ball according to the present invention includes the steps of:

dividing a surface of a phantom sphere into a plurality of units by comparting lines obtained by projecting sides of a regular polyhedron, which is inscribed in the phantom sphere, onto the phantom sphere;

arranging generating points on one unit;

developing the generating points to all the units to arrange a large number of generating points on the surface of the phantom sphere;

assuming a large number of Voronoi regions on the surface of the phantom sphere by a Voronoi tessellation based on the large number of generating points;

calculating a center of gravity of each of the Voronoi regions and setting these centers of gravity as new generating points; and assuming a larger number of new Voronoi regions on the surface of the phantom sphere by a Voronoi tessellation based on the new generating points.

DESCRIPTION OF THE PREFERRED EMBODIMENTS

The following will describe in detail the present invention, based on preferred embodiments with reference to the accompanying drawings.

Figure 1:
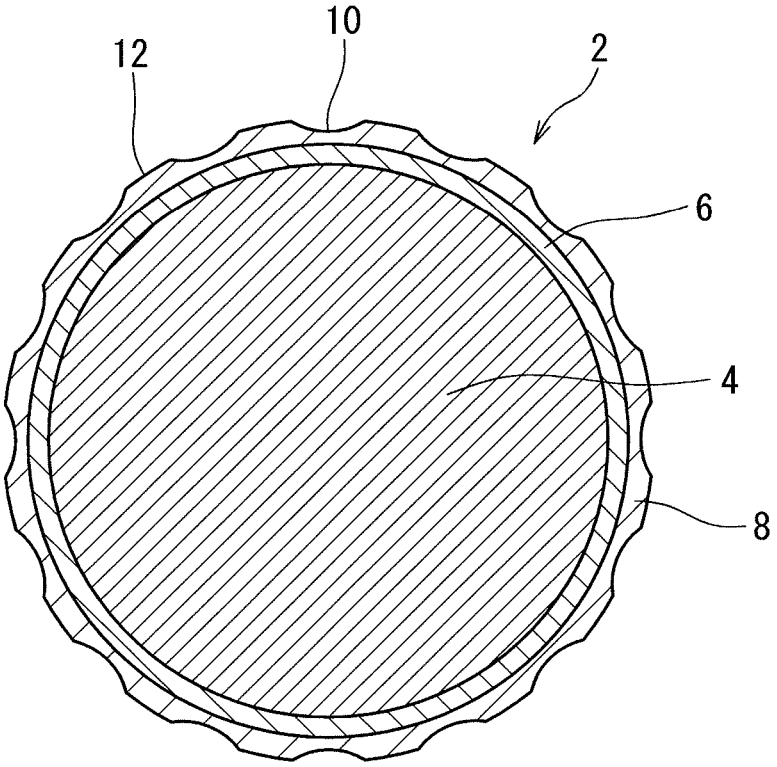
FIG. 1 is a schematic cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing.

The golf ball 2 preferably has a diameter of equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, a dispersant, a carboxylic acid, and a carboxylate. The rubber composition may include synthetic resin powder or crosslinked rubber powder.

The core 4 has a diameter of preferably equal to or greater than 30.0 mm and particularly preferably equal to or greater than 38.0 mm. The diameter of core 4 is preferably equal to or less than 42.0 mm and particularly preferably equal to or less than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably equal to or greater than 0.2 mm and particularly preferably equal to or greater than 0.3 mm. The thickness of the mid layer 6 is preferably equal to or less than 2.5 mm and particularly preferably equal to or less than 2.2 mm. The mid layer 6 has a specific gravity of preferably equal to or greater than 0.90 and particularly preferably equal to or greater than 0.95. The specific gravity of the mid layer 6 is preferably equal to or less than 1.10 and particularly preferably equal to or less than 1.05. The mid layer 6 may have two or more layers.

The cover 8 is formed from a resin composition. A preferable base polymer of the resin composition is a polyurethane. The resin composition may include a thermoplastic polyurethane or may include a thermosetting polyurethane. In light of productivity, the thermoplastic polyurethane is preferred. The thermoplastic polyurethane includes a polyurethane component as a hard segment, and a polyester component or a polyether component as a soft segment.

The polyurethane has a urethane bond within the molecule. The urethane bond can be formed by reacting a polyol with a polyisocyanate. The polyol, which is a material for the urethane bond, has a plurality of hydroxyl groups. Low-molecular-weight polyols and high-molecular-weight polyols can be used.

Examples of an isocyanate for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, the resin composition of the cover 8 may include another polymer. Examples of the other polymer include ionomer resins, polystyrenes, polyamides, polyesters, and polyolefins. The resin composition may include two or more polymers.

The resin composition of the cover 8 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 8 has a thickness of preferably equal to or greater than 0.2 mm and particularly preferably equal to or greater than 0.3 mm. The thickness of the cover 8 is preferably equal to or less than 2.5 mm and particularly preferably equal to or less than 2.2 mm. The cover 8 has a specific gravity of preferably equal to or greater than 0.90 and particularly preferably equal to or greater than 0.95. The specific gravity of the cover 8 is preferably equal to or less than 1.10 and particularly preferably equal to or less than 1.05. The cover 8 may have two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. Examples of the base polymer of the reinforcing layer include two-component curing type epoxy resins and two-component curing type urethane resins.

Figure 2:
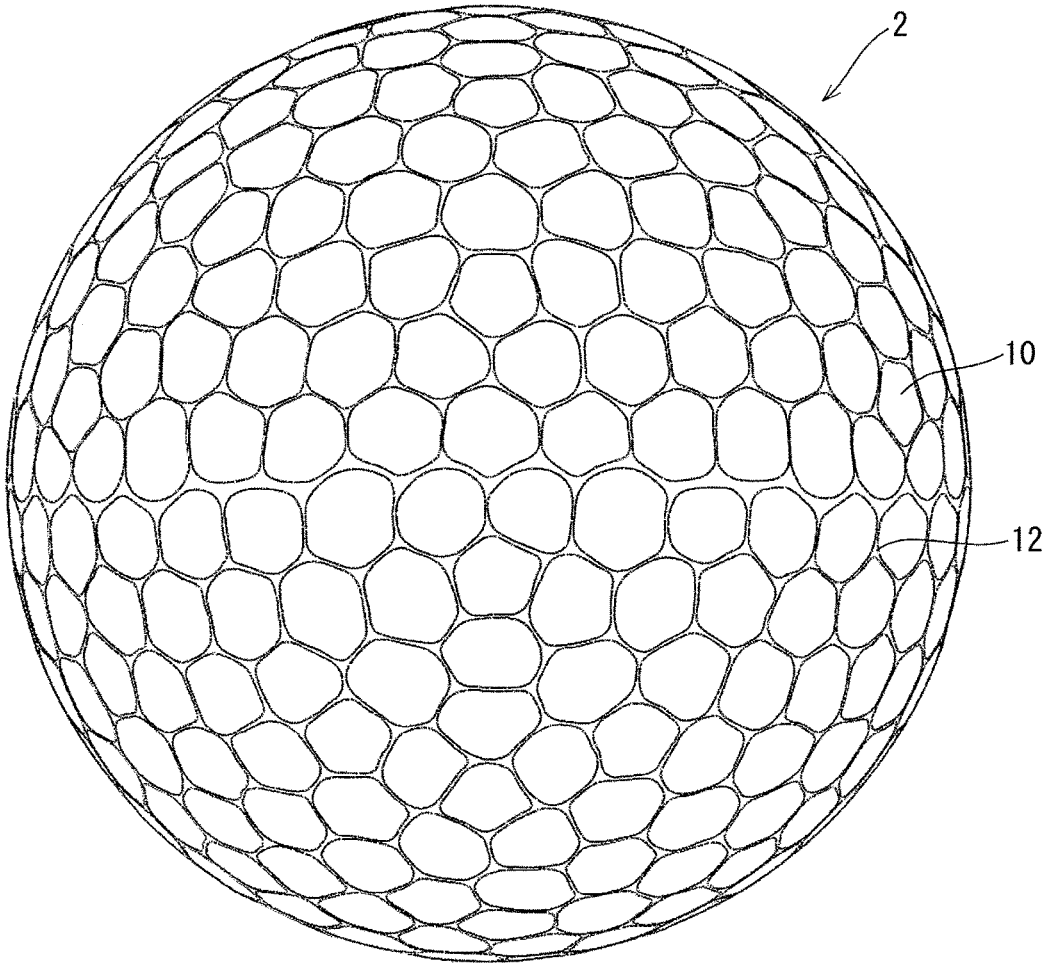
FIG. 2 is an enlarged front view of the golf ball in FIG. 1.
Figure 3:
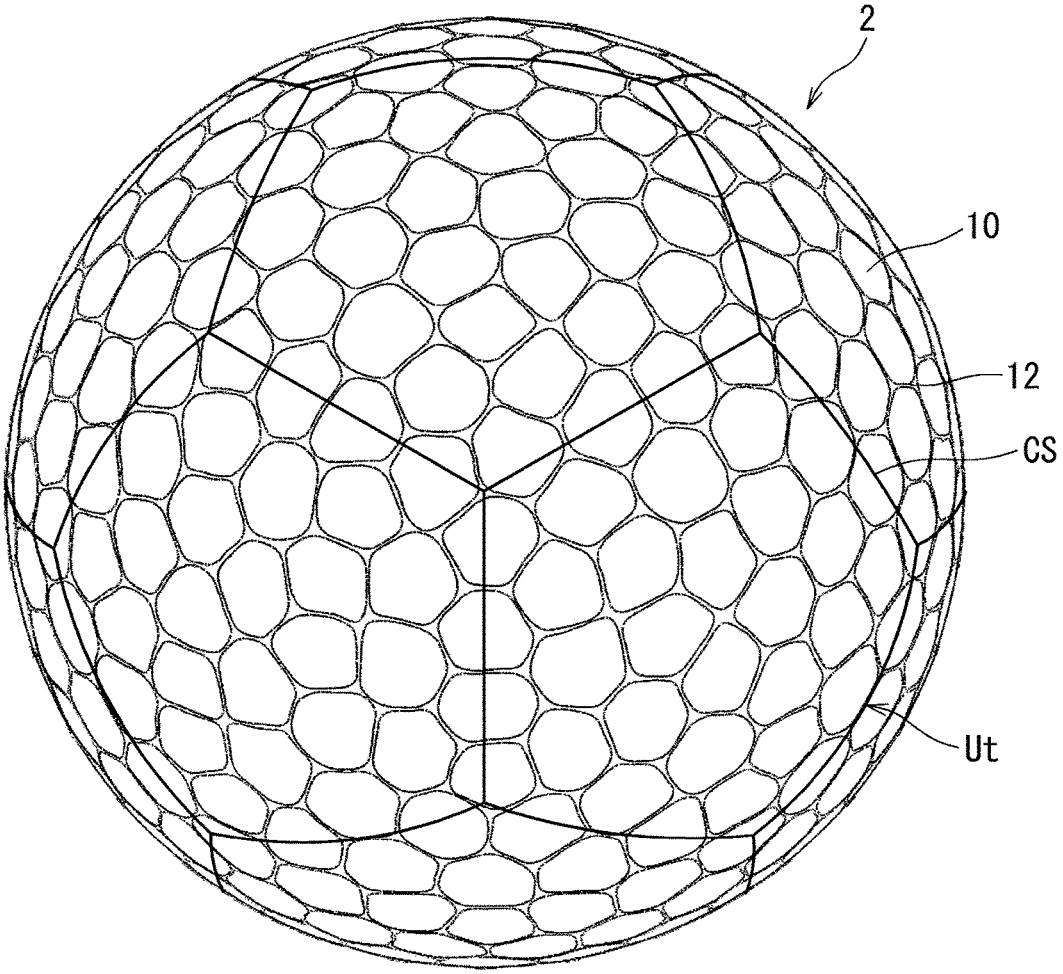
FIG. 3 is a plan view of the golf ball in FIG. 2.

FIG. 2 is an enlarged front view of the golf ball 2 in FIG. 1. FIG. 3 is a plan view of the golf ball 2 in FIG. 2. In FIG. 3, a large number of comparting lines CS are also drawn. These comparting lines CS are drawn based on a regular dodecahedron that is inscribed in the phantom sphere (described in detail later) of the golf ball. The comparting lines CS are obtained by projecting the sides of the regular dodecahedron onto the phantom sphere by light that radially travels from the center of the phantom sphere. These comparting lines CS are imaginary lines, and are not visually recognized on the actual golf ball. By these comparting lines CS, the surface of the phantom sphere is divided into 12 units Ut.

As obvious from FIGS. 2 and 3, the golf ball 2 has a large number of non-circular dimples 10. By these dimples 10 and a land, a pattern is formed on the surface of the golf ball 2.

In the golf ball 2, the dimples 10 are not orderly arranged. The golf ball 2 has a large number of types of dimples 10 whose contour shapes are different from each other. These dimples 10 achieve a superior dimple effect. The number of the types of the dimples 10 is preferably equal to or greater than 50 and particularly preferably equal to or greater than 100. In the present embodiment, each dimple 10 has a contour shape different from those of any other dimples 10.

In a process for designing the pattern, a Voronoi tessellation based on a regular dodecahedron is used. The designing process includes the steps of:

(1) arranging generating points on one unit Ut;

(2) developing the generating points to all the units Ut to arrange a large number of generating points on the surface of the phantom sphere;

(3) assuming a large number of Voronoi regions on the surface of the phantom sphere by a Voronoi tessellation based on the large number of generating points;

(4) calculating a center of gravity of each of the Voronoi regions and setting these centers of gravity as new generating points; and (5) assuming a larger number of new Voronoi regions on the surface of the phantom sphere by a Voronoi tessellation based on the new generating points.

In the present specification, regions assumed on the surface of the phantom sphere by a Voronoi tessellation are referred to as "Voronoi regions".

The designing process is preferably executed using a computer and software in light of efficiency. Of course, the present invention is practicable even by hand calculation. The essence of the present invention is not in a computer and software. The following will describe the designing process in detail.

Figure 4:
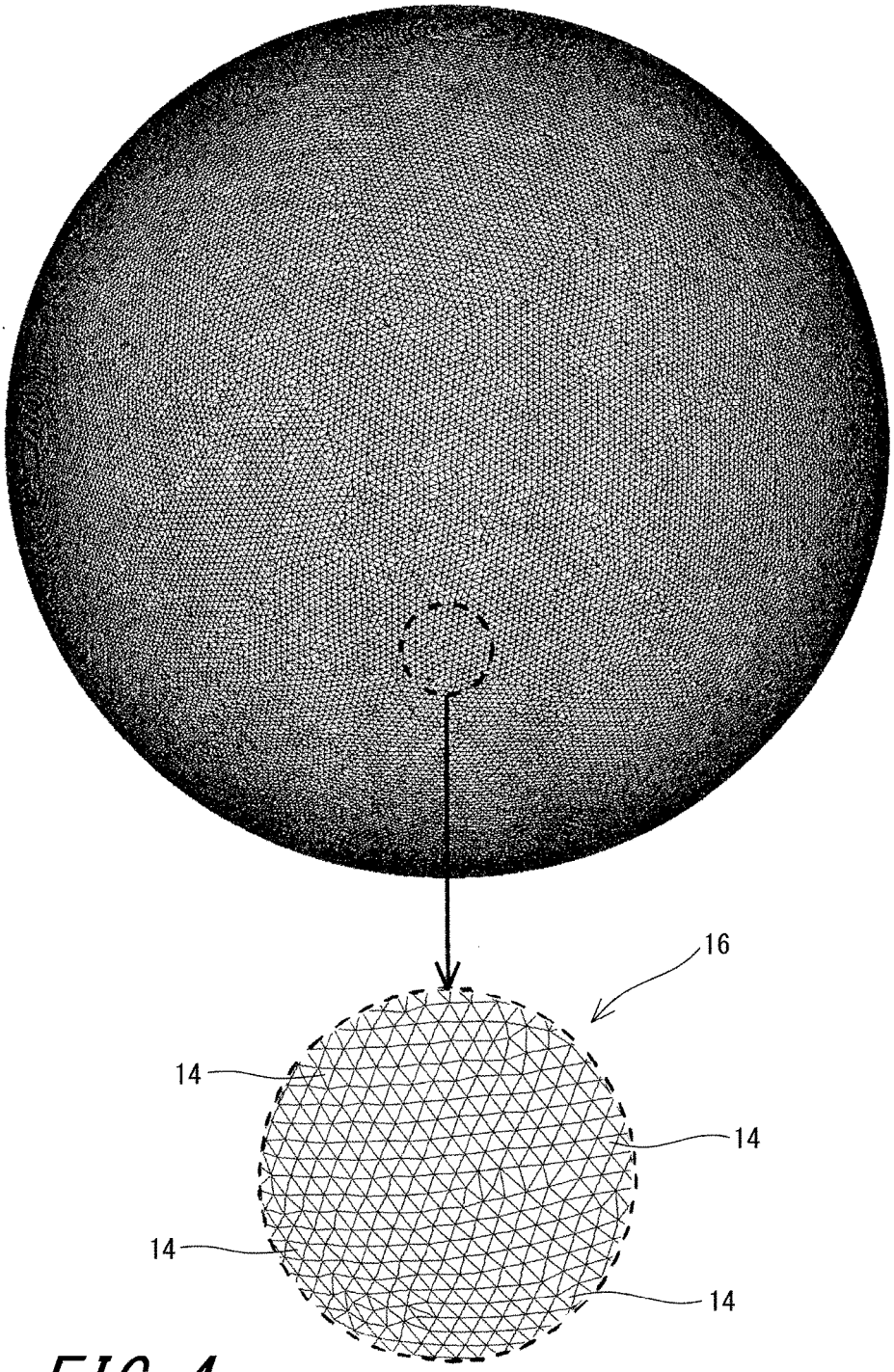
FIG. 4 is a front view of a mesh used in a designing process according to the present invention.

In the designing process, the surface of the phantom sphere is divided into a large number of spherical triangles 14. This division is performed based on an advancing front method. The advancing front method is disclosed at Pages 195 to 197 of "Daigakuin Johoshorikogaku 3, Keisan Rikigaku (Information Science and Technology for Graduate School 3, Computational Dynamics)" (edited by Koichi ITO, published by Kodansha Ltd.). A mesh 16 shown in FIG. 4 is obtained by this division. The mesh 16 has 314086 triangles 14 and 157045 vertices. Each vertex is defined as a cell (or the center of a cell). The mesh 16 has 157045 cells. The phantom sphere 14 may be divided by other methods. The number of the cells is preferably equal to or greater than 10000 and particularly preferably equal to or greater than 100000.

Figure 5:
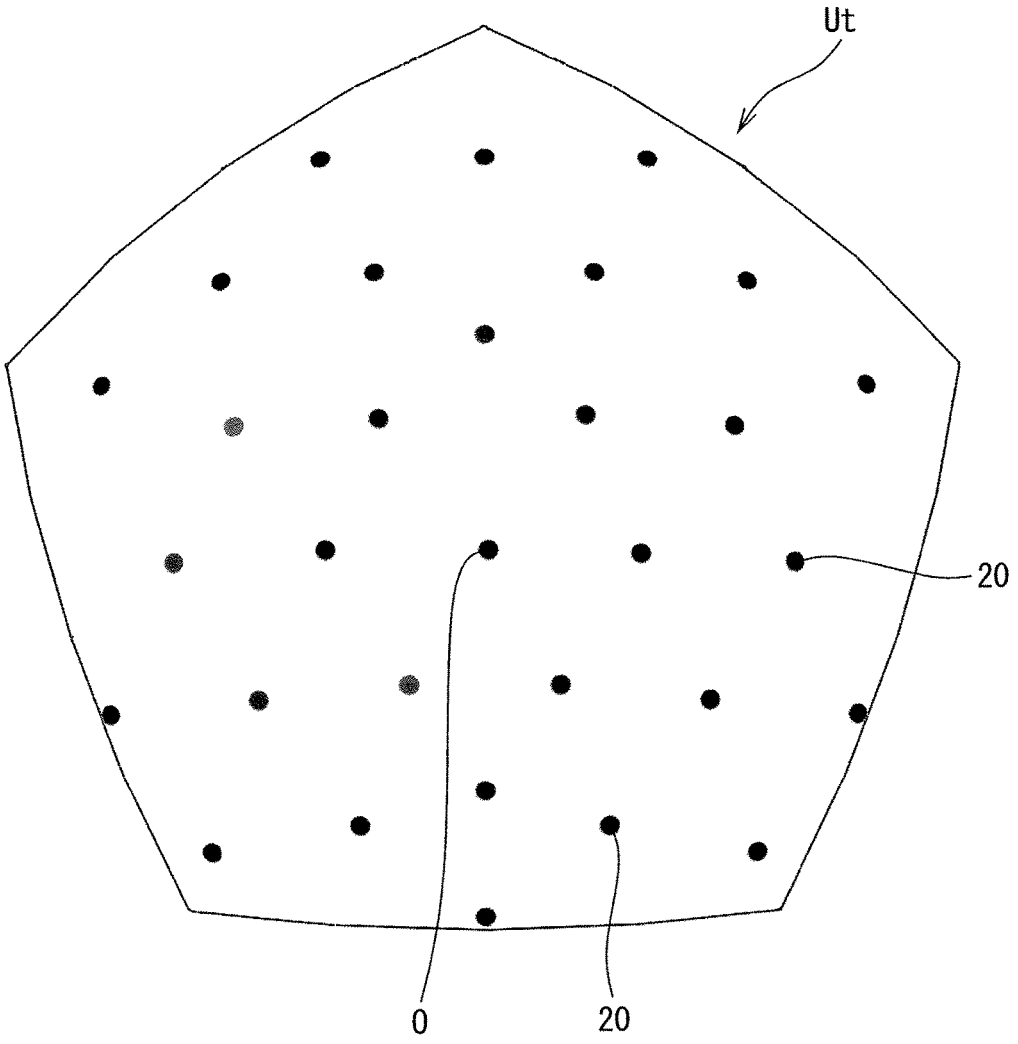
FIG. 5 is a front view showing generating points on one unit.

As shown in FIG. 5, generating points 20 are arranged on one unit Ut. In this embodiment, a pattern of the generating points 20 is rotationally symmetrical about the center O of the unit Ut. The rotation angle is 72°. The centers of dimples in a circular dimple pattern arranged on the unit Ut may be set as generating points 20.

Figure 6:
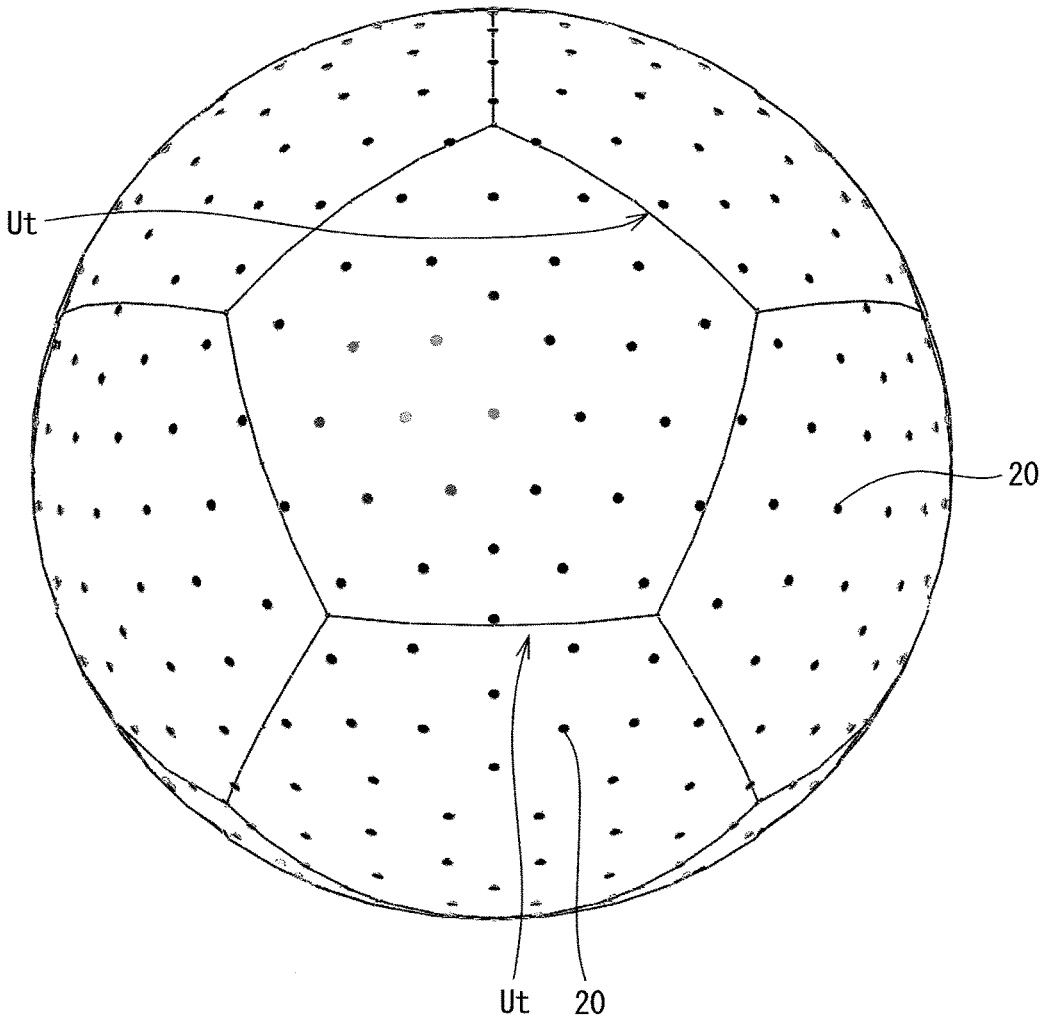
FIG. 6 is a front view showing generating points on a phantom sphere.

The pattern of the generating points 20 on the unit Ut shown in FIG. 5 is copied to all the units Ut. The phantom sphere after the copying is shown in FIG. 6. In the present embodiment, the total number of the generating points 20 is 396.

Figure 7:
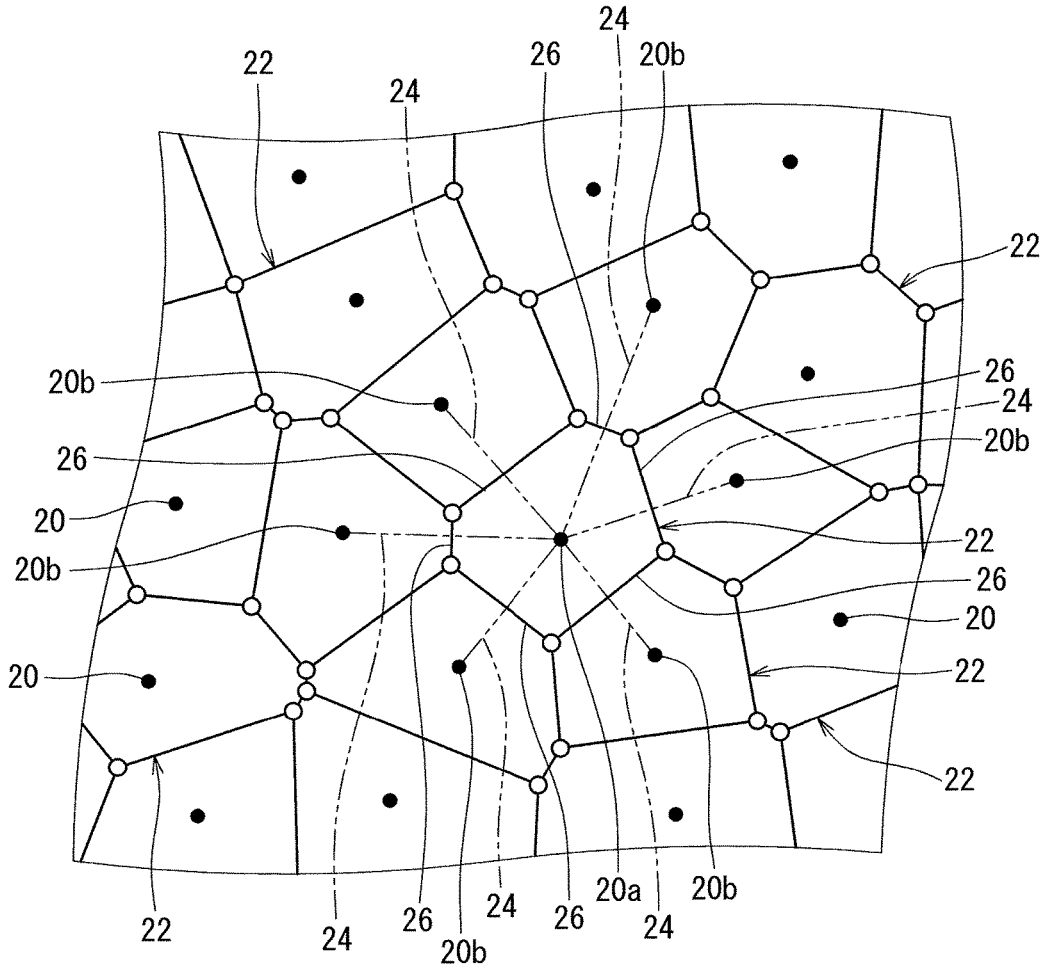
FIG. 7 is an enlarged view showing the generating points in FIG. 6 together with Voronoi regions.

Based on these generating points 20, a large number of Voronoi regions are assumed. FIG. 7 shows Voronoi regions 22. In FIG. 7, a generating point 20*a* is adjacent to six generating points 20*b*. Each reference sign 24 indicates a line segment connecting the generating point 20*a* to the generating point 20*b*. FIG. 7 shows six line segments 24. Each reference sign 26 indicates the perpendicular bisector of the line segment 24. The generating point 20*a* is surrounded by six perpendicular bisectors 26. Each outline circle in FIG. 7 indicates the intersection point between a perpendicular bisector 26 and another perpendicular bisector 26. A point obtained by projecting the intersection point onto the surface of the phantom sphere is a vertex of a spherical polygon (e.g., a spherical hexagon). This projection is performed by light emitted from the center of the phantom sphere. The spherical polygon is a Voronoi region 22. The surface of the phantom sphere is divided into a large number of the Voronoi regions 22. The method for the division is referred to as a Voronoi tessellation. In the present embodiment, since the number of the generating points 20 is 396, the number of the Voronoi regions 22 is 396.

Calculation for defining the contour of each Voronoi region 22 based on the perpendicular bisectors 26 is complicated. The following will describe a method for simply obtaining Voronoi regions 22. In the method, for each cell in the mesh 16 shown in FIG. 4, the distances between the cell and the respective generating points 20 are calculated. The shortest distance is selected from among these distances. The cell is associated with the generating point 28 on which the shortest distance is based. In other words, the generating point 20 that is closest to the cell is selected. It is noted that calculation of the distances between the cell and the generating points 20 whose distances from the cell are obviously large may be omitted.

Figure 8:
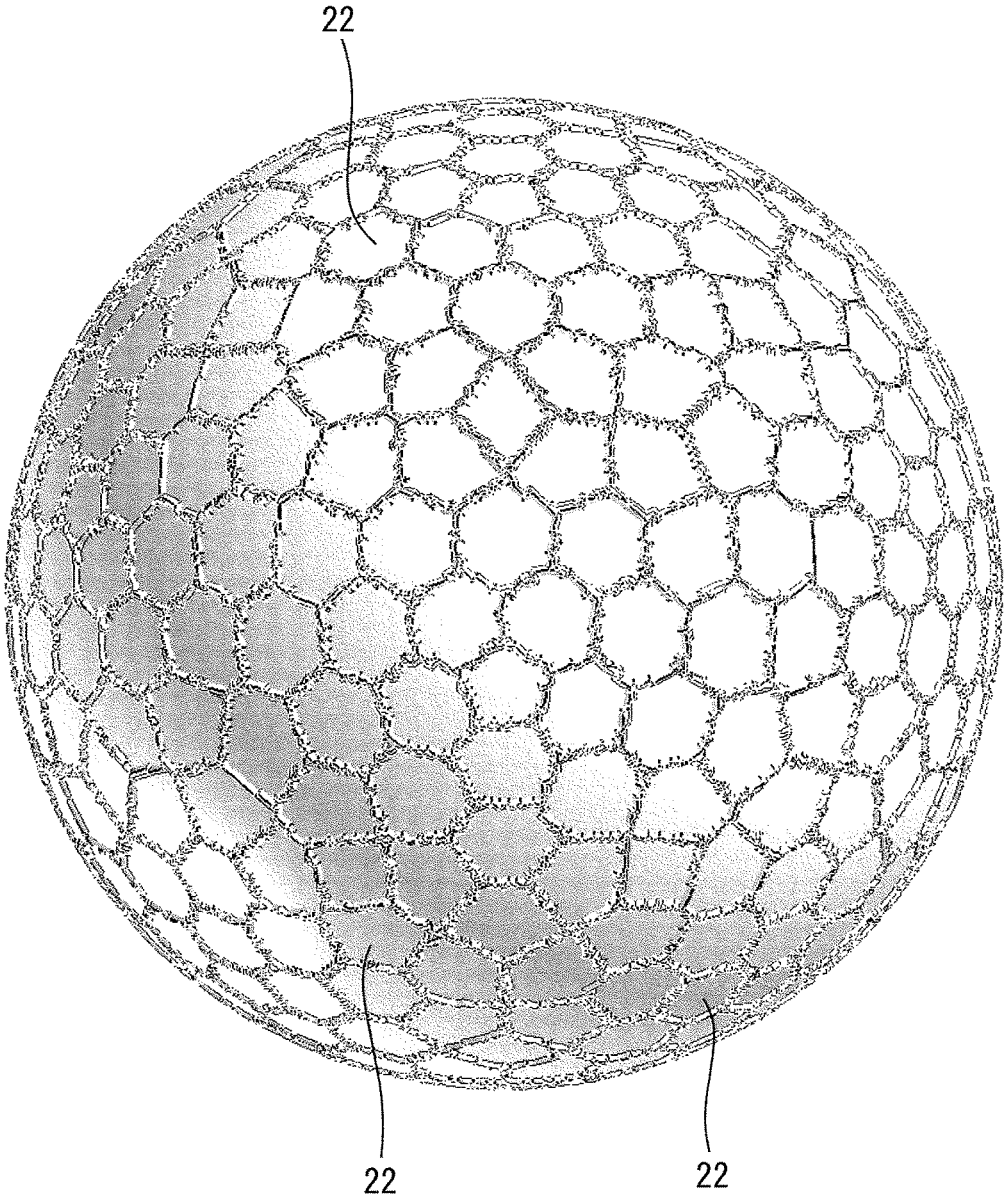
FIG. 8 is a front view showing a pattern of Voronoi regions obtained based on the generating points in FIG. 6.

For each generating point 20, a set of cells associated with the generating point 20 is assumed. In other words, a set of cells for which this generating point 20 is the closest generating point 20 is assumed. The set is regarded as a Voronoi region 22. A large number of the Voronoi regions 22 thus obtained are shown in FIG. 8. In FIG. 8, when another cell adjacent to a certain cell belongs to a Voronoi region 22 different from a Voronoi region 22 to which the certain cell belongs, the certain cell is filled with black.

As is obvious from FIG. 8, the contour of each Voronoi region 22 is a zigzag contour. This contour is subjected to smoothing or the like. Typical smoothing is moving averaging. Smoothing by three-point moving average, five-point moving average, seven-point moving average, or the like can be used.

In the three-point moving average, coordinates of the following three cells are averaged:

(1) a cell;

(2) a cell that is closest to the cell in a clockwise direction; and (3) a cell that is closest to the cell in a counterclockwise direction.

In the five-point moving average, coordinates of the following five cells are averaged:

(1) a cell;

(2) a cell that is closest to the cell in the clockwise direction;

(3) a cell that is closest to the cell in the counterclockwise direction;

(4) a cell that is second closest to the cell in the clockwise direction; and (5) a cell that is second closest to the cell in the counterclockwise direction.

In the seven-point moving average, coordinates of the following seven cells are averaged:

(1) a cell;

(2) a cell that is closest to the cell in the clockwise direction;

(3) a cell that is closest to the cell in the counterclockwise direction;

(4) a cell that is second closest to the cell in the clockwise direction;

(5) a cell that is second closest to the cell in the counterclockwise direction;

(6) a cell that is third closest to the cell in the clockwise direction; and (7) a cell that is third closest to the cell in the counterclockwise direction.

A plurality of points having the coordinates obtained by the moving average are connected to each other by a spline curve. A loop is obtained by the spline curve. When forming a loop, some of the points may be removed, and a spline curve may be drawn. The loop may be enlarged or reduced in size to obtain a new loop. In the present invention, the loop is also referred to as Voronoi region 22. In this manner, a pattern of Voronoi regions 22 shown in FIG. 9 is obtained.

Figure 9:
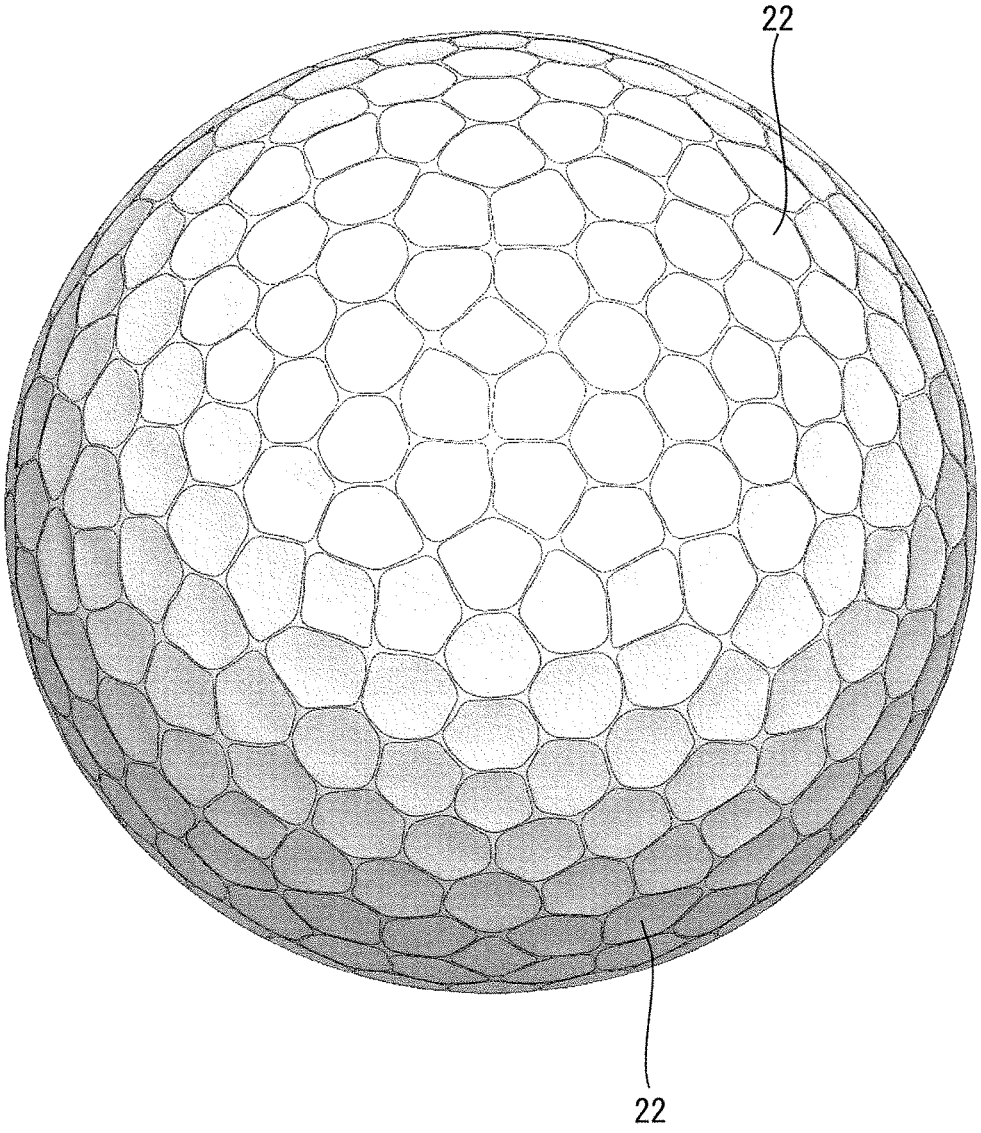
FIG. 9 is a front view showing a pattern obtained by performing smoothing on the pattern in FIG. 8.
Figure 10:
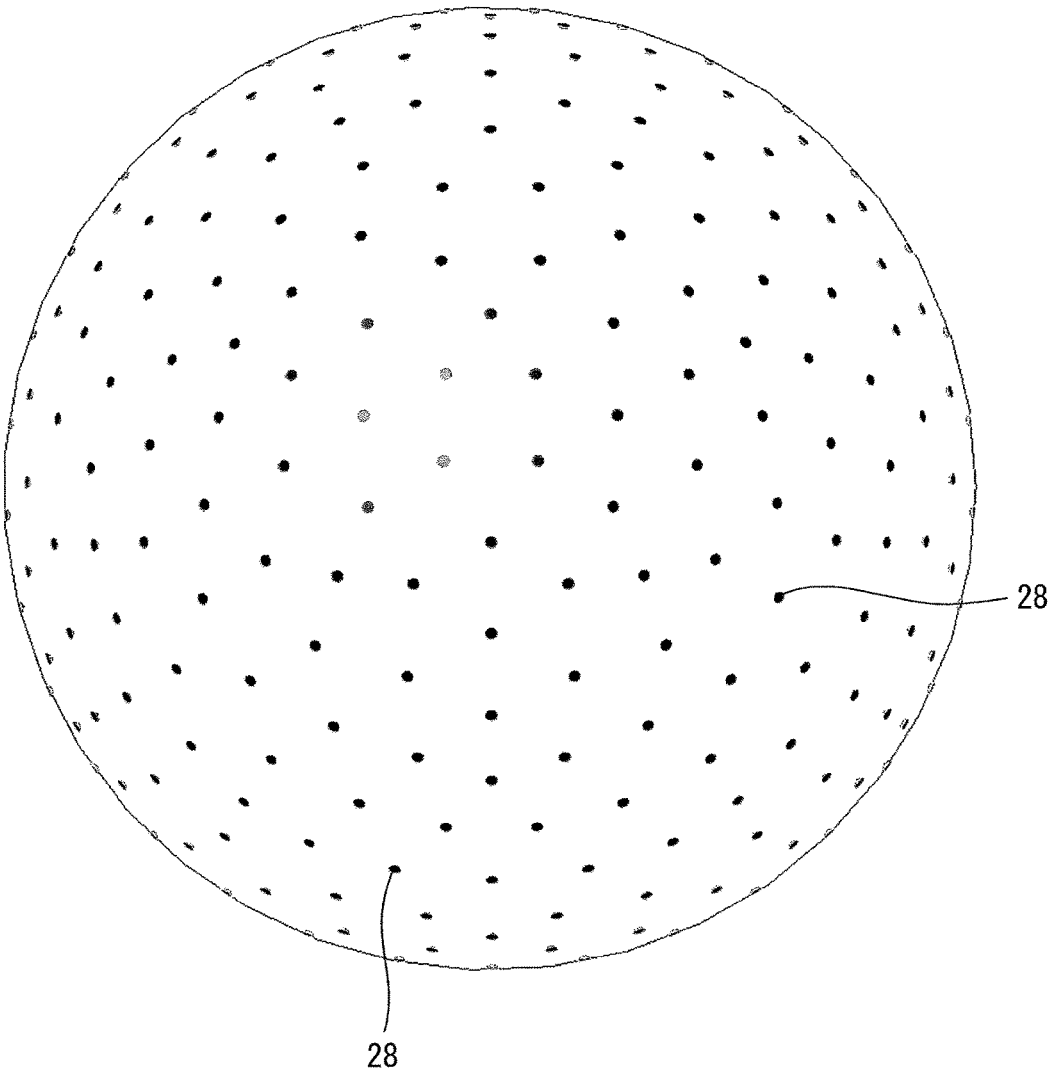
FIG. 10 is a front view showing generating points for the pattern in FIG. 9.

The center of gravity of each of the Voronoi regions 22 shown in FIG. 9 is calculated. The center of gravity is a new generating point 28. A large number of new generating points 28 are shown in FIG. 10. The center of gravity of each Voronoi region 22 shown in FIG. 8 may be set as a new generating point 28.

By a Voronoi tessellation based on these new generating points 28, a large number of new Voronoi regions are assumed on the phantom sphere. The contours of the Voronoi regions may be subjected to smoothing or the like.

Setting of new generating points and assumption of new Voronoi regions are repeated. Loops obtained when the number of repeats n is 20 are shown in FIGS. 2 and 3. The loops are Voronoi regions and dimples.

A land is assigned to the outside of each loop. In other words, a land is assigned to the vicinity of the contour of each Voronoi region. Meanwhile, a dimple is assigned to the inside of each loop or onto each loop.

In the pattern shown in FIGS. 2 and 3, variation in the sizes of the Voronoi region 22 is small as compared to the pattern shown in FIG. 9. Repeating of Voronoi tessellation reduces the variation in the sizes. The golf ball 2 having the pattern shown in FIGS. 2 and 3 has excellent flight distance performance. The reason is that many dimples 10 exert a sufficient dimple effect. In light of flight distance performance, the number of repeats n is preferably equal to or greater than 5, more preferably equal to or greater than 10, and particularly preferably equal to or greater than 15.

Initial generating points may be set based on a regular polyhedron other than a regular dodecahedron, and a dimple pattern may be obtained by a Voronoi tessellation based on the generating points. A regular tetrahedron, a regular hexahedron, a regular octahedron, and a regular icosahedron can be used. From the standpoint that the number of obtained units Ut is large, a regular dodecahedron and a regular icosahedron are preferable.

Figure 11:
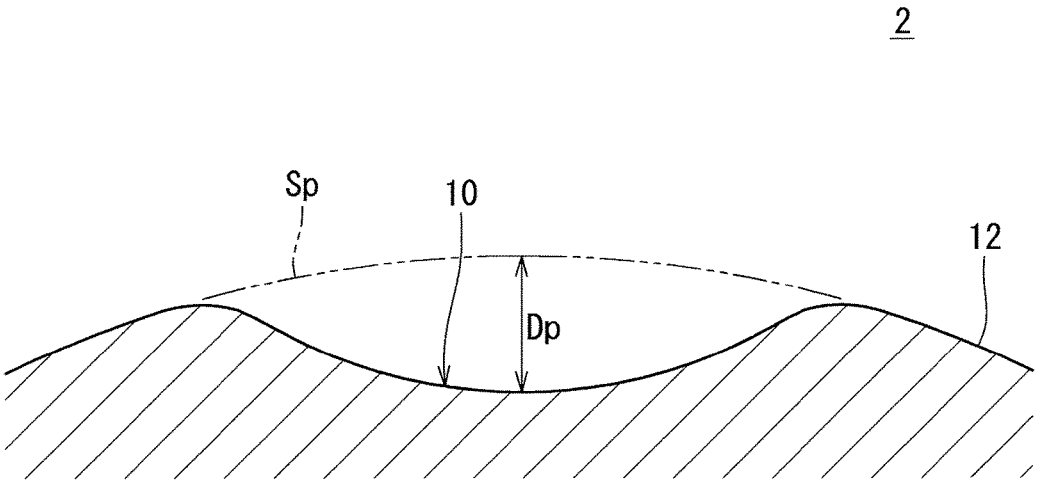
FIG. 11 is a schematic partially enlarged view of the golf ball in FIG. 1.

FIG. 11 shows a cross section along a plane passing through the center of the dimple 10 and the center of the golf ball 2. In FIG. 11, the top-to-bottom direction is the depth direction of the dimple 10. In FIG. 11, a chain double-dashed line Sp indicates a phantom sphere. The surface of the phantom sphere Sp is the surface of the golf ball 2 when it is postulated that no dimple 10 exists. The dimple 10 is recessed from the surface of the phantom sphere Sp. The land 12 coincides with the surface of the phantom sphere Sp.

The surface of the phantom sphere Sp can be divided into 12 units Ut each of which meets the following mathematical formula (I), by comparting lines CS which are obtained by projecting the sides of a regular dodecahedron, which is inscribed in the phantom sphere Sp, onto the phantom sphere Sp.

$$-2 \leq (Nt/12) - Nu \leq 2 \quad \text{(I)}$$

In the mathematical formula (I), Nt represents the total number of the dimples 10 and Nu represents the number of dimples on one unit Ut.

In the dimple pattern which meets the above mathematical formula (I), the difference in characteristics among the units Ut is small. The pattern inherits the characteristics of a regular dodecahedron pattern although the pattern is obtained through the Voronoi tessellation. The golf ball 2 has excellent aerodynamic symmetry.

The dimple number Nt of the golf ball 2 shown in FIGS. 2 and 3 is 396. Therefore, (Nt/12) is 33. The dimple number Nu(max) of the unit Ut having the largest number of the dimples 10 contained therein, among the 12 units Ut shown in FIG. 3, is 35. The dimple number Nu(min) of the unit Ut having the smallest number of the dimples 10 contained therein, among the 12 units Ut shown in FIG. 3, is 31. Therefore, the pattern meets the above mathematical formula (I). The difference between the dimple number Nu(max) and the dimple number Nu(min) is 4.

The difference between the dimple number Nu(max) and the dimple number Nu(min) is more preferably equal to or less than 3 and particularly preferably equal to or less than 2. Ideally, the difference is zero.

For the dimple 10 that intersects the comparting line CS, the unit Ut to which the dimple 10 belongs is determined based on the center of gravity of the dimple 10. The unit Ut to which the center of gravity belongs is the unit Ut to which the dimple 10 belongs. The dimple 10 whose center of gravity is located on the comparting line CS is divided and belongs to the two units Ut between which the comparting line CS is located. Specifically, ½ is added to the dimple number Nu of one of the units Ut, and ½ is added to the dimple number Nu of the other of the units Ut. When the center of gravity is located at the vertex of the regular dodecahedron, ⅓ is added to the dimple number Nu of each of the units Ut having this vertex.

There are numerous regular dodecahedrons that are inscribed in the phantom sphere Sp. It suffices if, by any of the regular dodecahedrons, division is performed such that the above mathematical formula (I) is met. In the present embodiment, when the phantom sphere Sp is divided by the comparting lines CS shown in FIG. 3, the above mathematical formula (I) is met.

In a dimple pattern based on a regular tetrahedron, regular hexahedron, or a regular octahedron, the number of the unit Ut is small. Therefore, the pattern is inferior in aerodynamic symmetry. A regular icosahedron and a regular dodecahedron have a duality relationship. Therefore, in a pattern having a small difference among units Ut that are demarcated based on a regular dodecahedron, the difference among units that are demarcated based on a regular icosahedron also tends to be small. From these standpoints, the present inventor divides the phantom sphere Sp based on a regular dodecahedron, which is used for an index that correlates with aerodynamic symmetry.

In FIG. 11, a double ended arrow Dp indicates the depth of the dimple 10. The depth Dp is the distance between the deepest part of the dimple 10 and the phantom sphere Sp. In light of suppression of rising of the golf ball 2 during flight, the depth Dp is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.60 mm, more preferably equal to or less than 0.55 mm, and particularly preferably equal to or less than 0.50 mm.

The area s of the dimple 10 is the area of a region surrounded by the contour of the dimple 10 when the center of the golf ball 2 is viewed at infinity. In the present invention, the ratio of the sum of the areas of all the dimples 10 relative to the surface area of the phantom sphere Sp is referred to as occupation ratio So. From the standpoint that a sufficient dimple effect is obtained, the occupation ratio So is preferably equal to or greater than 80%, more preferably equal to or greater than 82%, and particularly preferably equal to or greater than 84%. The occupation ratio So is preferably equal to or less than 95%. Since the golf ball 2 has the non-circular dimples 10, a high occupation ratio So can be achieved. The ratio of the number of the non-circular dimples 10 relative to the total number Nt of the dimples 10 is preferably equal to or greater than 50% and particularly preferably equal to or greater than 70%. In the golf ball 2 shown in FIGS. 2 and 3, this ratio is 100%.

In the golf ball 2, the standard deviation σ of the areas of the dimples 10 is equal to or less than 1.7 $mm^2$. The golf ball 2 having a standard deviation σ in this range has excellent flight distance performance. The reason is that many dimples 10 exert a sufficient dimple effect. In light of flight distance performance, the standard deviation σ is more preferably equal to or less than 1.5 $mm^2$ and particularly preferably equal to or less than 1.2 $mm^2$. By repeating Voronoi tessellation, a low standard deviation σ can be achieved.

From the standpoint that a sufficient occupation ratio is achieved, the total number Nt of the dimples 10 is preferably equal to or greater than 250, more preferably equal to or greater than 280, and particularly preferably equal to or greater than 300. From the standpoint that each dimple 10 can contribute to turbulization, the total number Nt is preferably equal to or less than 450, more preferably equal to or less than 400, and particularly preferably equal to or less than 380.

In the present invention, the "volume of the dimple" means the volume of a portion surrounded by the phantom sphere Sp and the surface of the dimple 10. The total volume of the dimples 10 is preferably equal to or greater than 520 $mm^3$ but equal to or less than 720 $mm^3$. With the golf ball 2 in which the total volume is equal to or greater than 520 $mm^3$, rising thereof during flight is suppressed. From this standpoint, the total volume is particularly preferably equal to or greater than 540 $mm^3$. With the golf ball 2 in which the total volume is equal to or less than 720 $mm^3$, dropping thereof during flight is suppressed. From this standpoint, the total volume is particularly preferably equal to or less than 680 $mm^3$.

EXAMPLES

Example 1

A rubber composition was obtained by kneading 100 parts by weight of a high-cis polybutadiene (trade name "BR-730", manufactured by JSR Corporation), 30 parts by weight of zinc diacrylate, 5 parts by weight of zinc oxide, 5 parts by weight of barium sulfate, 0.3 parts by weight of bis(pentabromophenyl)disulfide, and 1.05 parts by weight of dicumyl peroxide. This rubber composition was placed into a mold including upper and lower mold halves each having a hemispherical cavity, and heated at 170° C. for 18 minutes to obtain a center with a diameter of 39.7 mm.

A resin composition was obtained by kneading 50 parts by weight of an ionomer resin (trade name "Surlyn 8945", manufactured by E.I. du Pont de Nemours and Company) and 50 parts by weight of another ionomer resin ("Himilan AM7329", manufactured by Du Pont-MITSUI POLYCHEMICALS Co., Ltd.) with a twin-screw kneading extruder. The core was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g. The dimple specifications of the golf ball are shown in detail in Table 1 below.

Examples 2 and 3 and Comparative Examples 1 to 4

Golf balls of Examples 2 and 3 and Comparative Examples 1 to 4 were obtained in the same manner as Example 1, except the final mold was changed and the specifications of the dimples were as shown in Tables 1 and 2 below.

[Flight Test]

A driver with a head made of a titanium alloy (trade name "SRIXON Z-TX", manufactured by DUNLOP SPORTS CO. LTD., shaft hardness: X, loft angle: 8.5°) was attached to a swing machine manufactured by Golf Laboratories, Inc. A golf ball was hit under the conditions of: a head speed of 50 m/sec; a launch angle of about 10.5°; and a backspin rate of about 2300 rpm, and the distance from the hitting point to the point at which the ball stopped was measured. Hitting for each of POP rotation and PH rotation was performed 20 times, and the average of the flight distances upon each of POP rotation and PH rotation was calculated. The results are shown in Tables 1 and 2 below. An axis for PH rotation passes through both poles. An axis for POP rotation is orthogonal to the axis for PH rotation.

TABLE 1

Results of Evaluation

Figure 12:
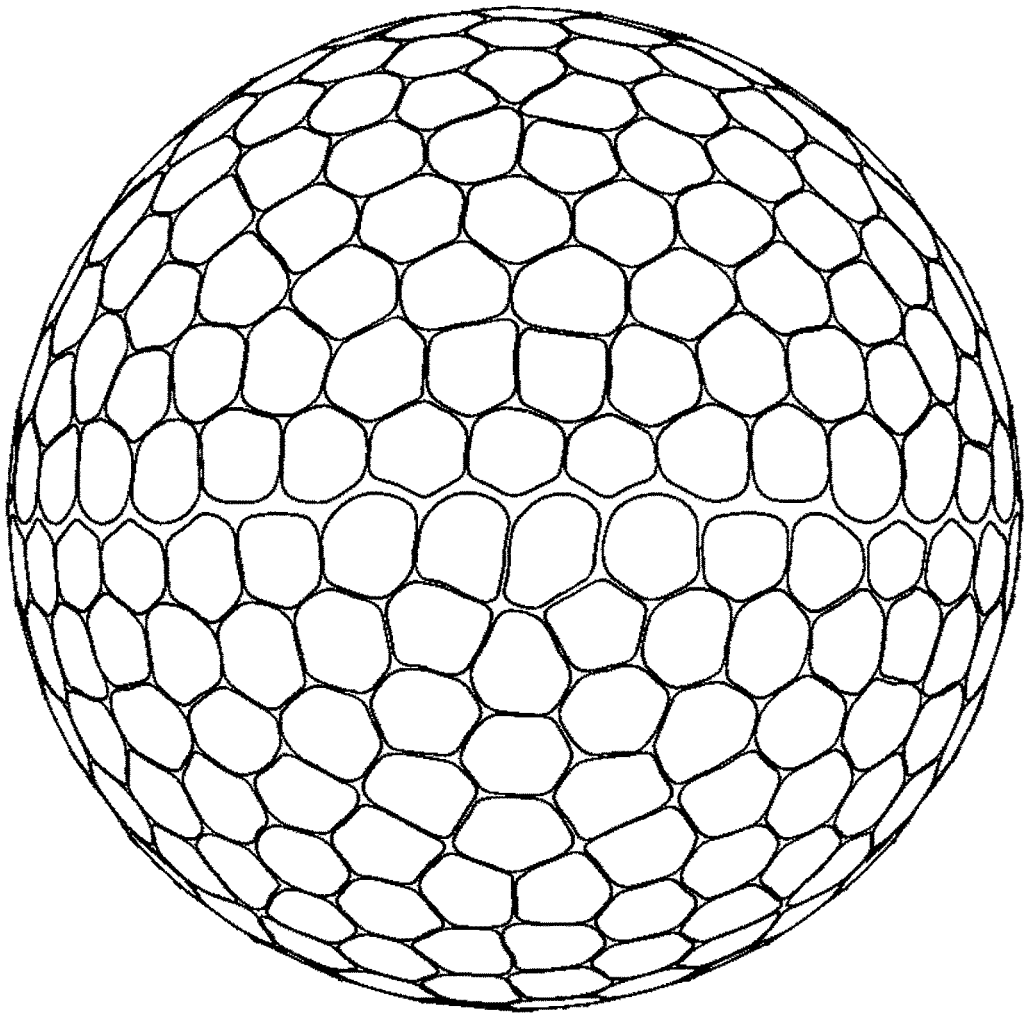
FIG. 12 is a front view of a golf ball according to Example 2 of the present invention.
Figure 13:
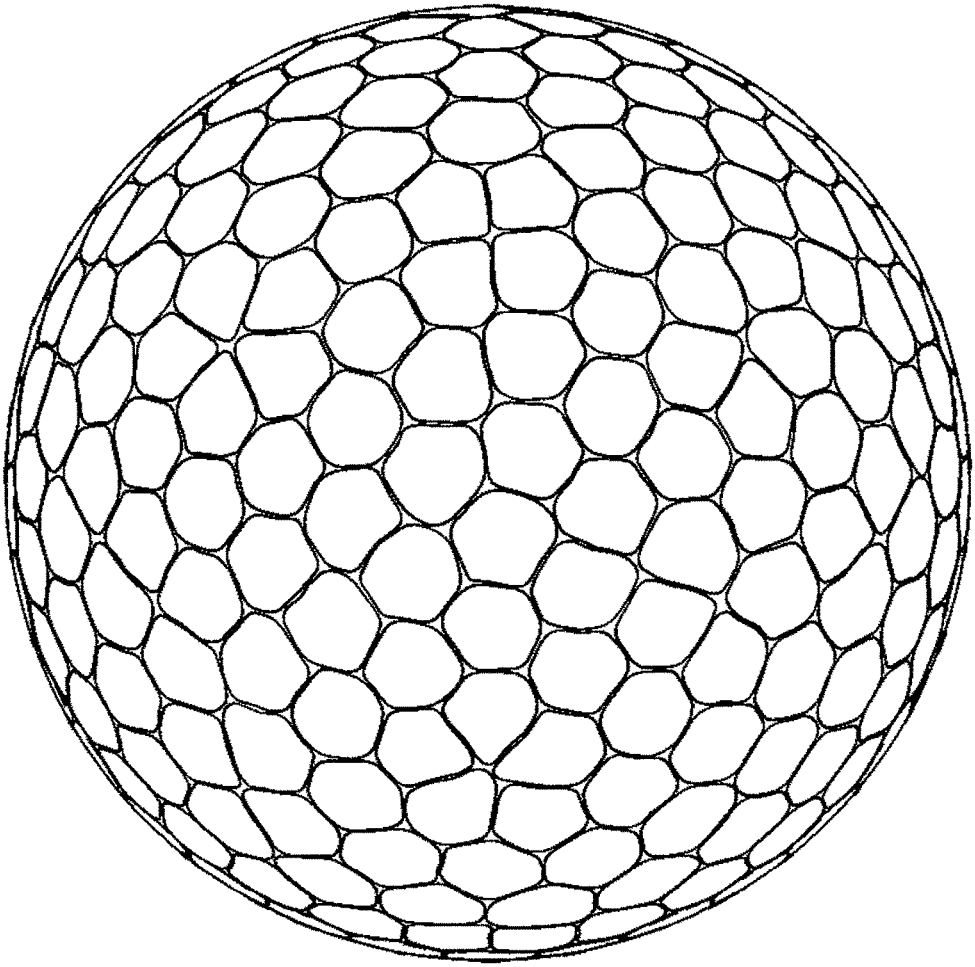
FIG. 13 is a plan view of the golf ball in FIG. 12.
Figure 14:
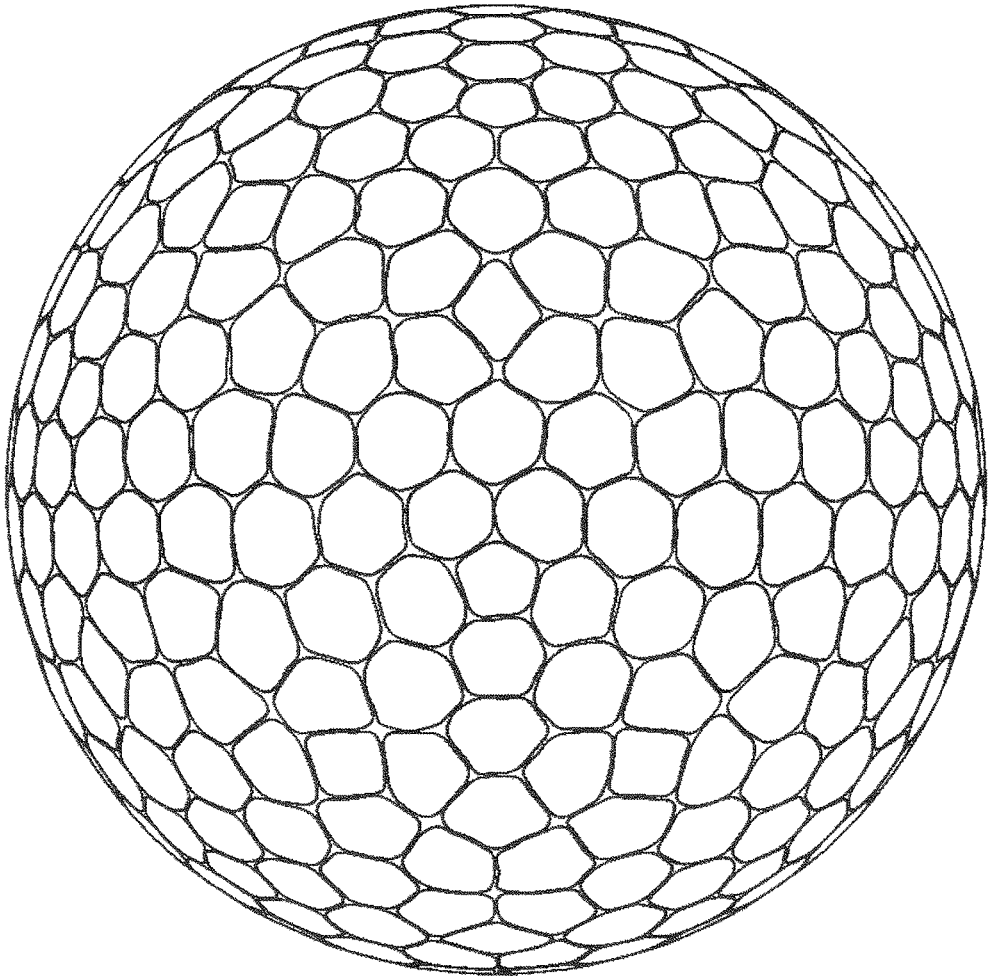
FIG. 14 is a front view of a golf ball according to Example 3 of the present invention.
Figure 15:
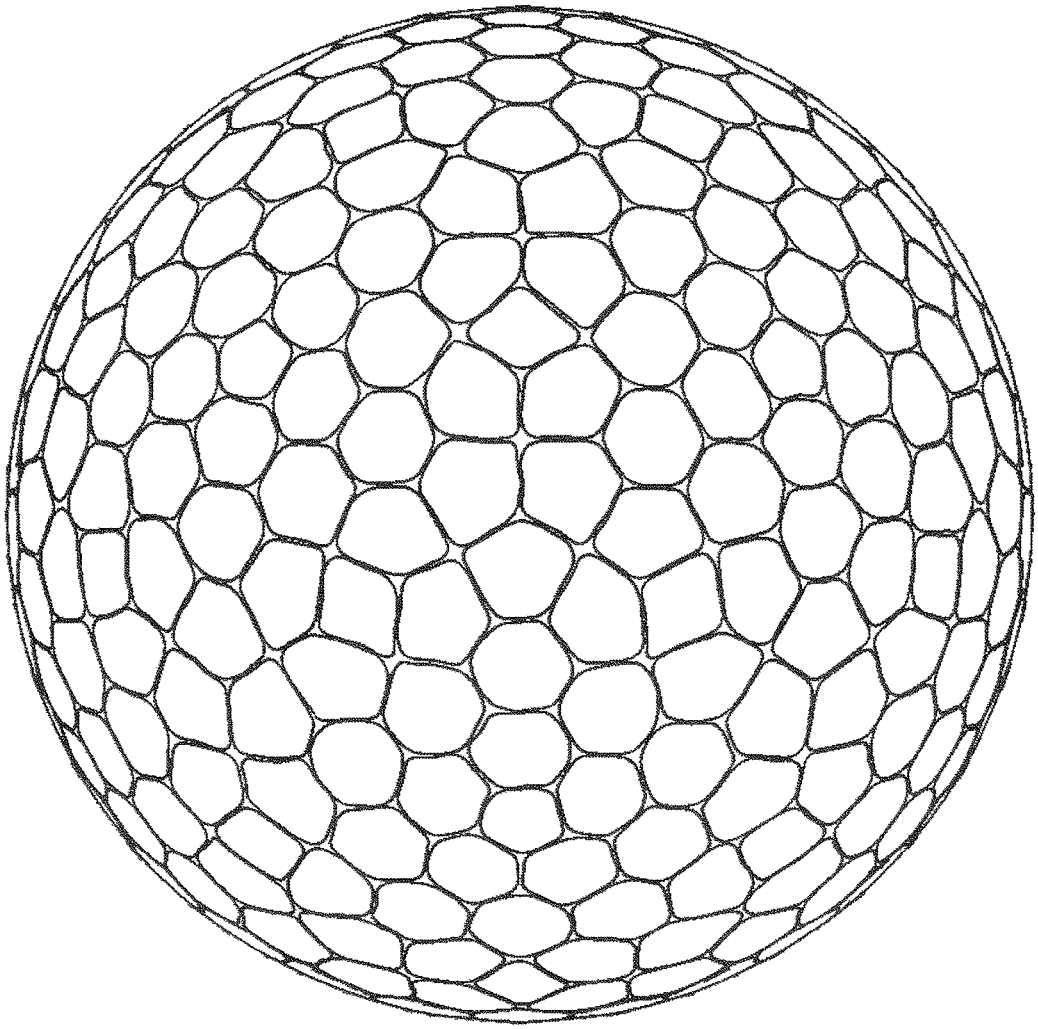
FIG. 15 is a plan view of the golf ball in FIG. 14.

| | Example 1 | Example 2 | Example 3 |
|---|---|---|---|
| Front view | FIG. 2 | FIG. 12 | FIG. 14 |
| Plan view | FIG. 3 | FIG. 13 | FIG. 15 |
| Designing process | P.D. V.T. | P.D. V.T. | P.D. V.T. |
| Nt | 396 | 360 | 396 |
| Nu (max) | 35 | 30 | 35 |
| Nu (min) | 31 | 30 | 31 |
| Number of repeats of V.T. | 20 | 20 | 0 |
| Depth (mm) | 0.25 | 0.25 | 0.25 |
| Shape | Non-circular | Non-circular | Non-circular |
| Volume ($cm^3$) | 600 | 600 | 600 |
| So (%) | 92% | 92% | 92% |
| σ ($mm^2$) | 1.2 | 1.2 | 1.7 |
| Flight distance (m) | | | |
| POP | 264.3 | 264.8 | 263.9 |
| PH | 263.3 | 263.9 | 262.9 |
| Difference | 1.0 | 0.9 | 1.0 |

P.D.: Polyhedron division
V.T.: Voronoi tessellation

TABLE 2

Results of Evaluation

Figure 16:
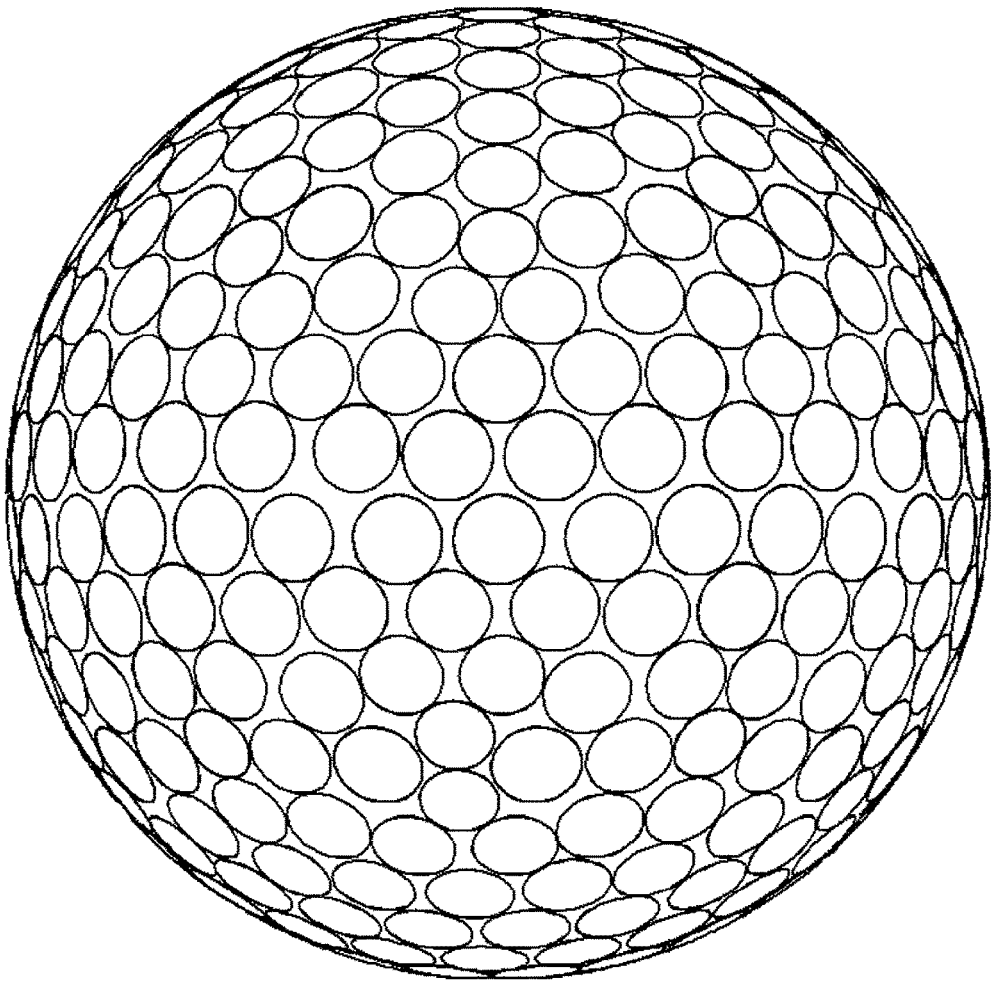
FIG. 16 is a front view of a golf ball according to Comparative Example 1.
Figure 17:
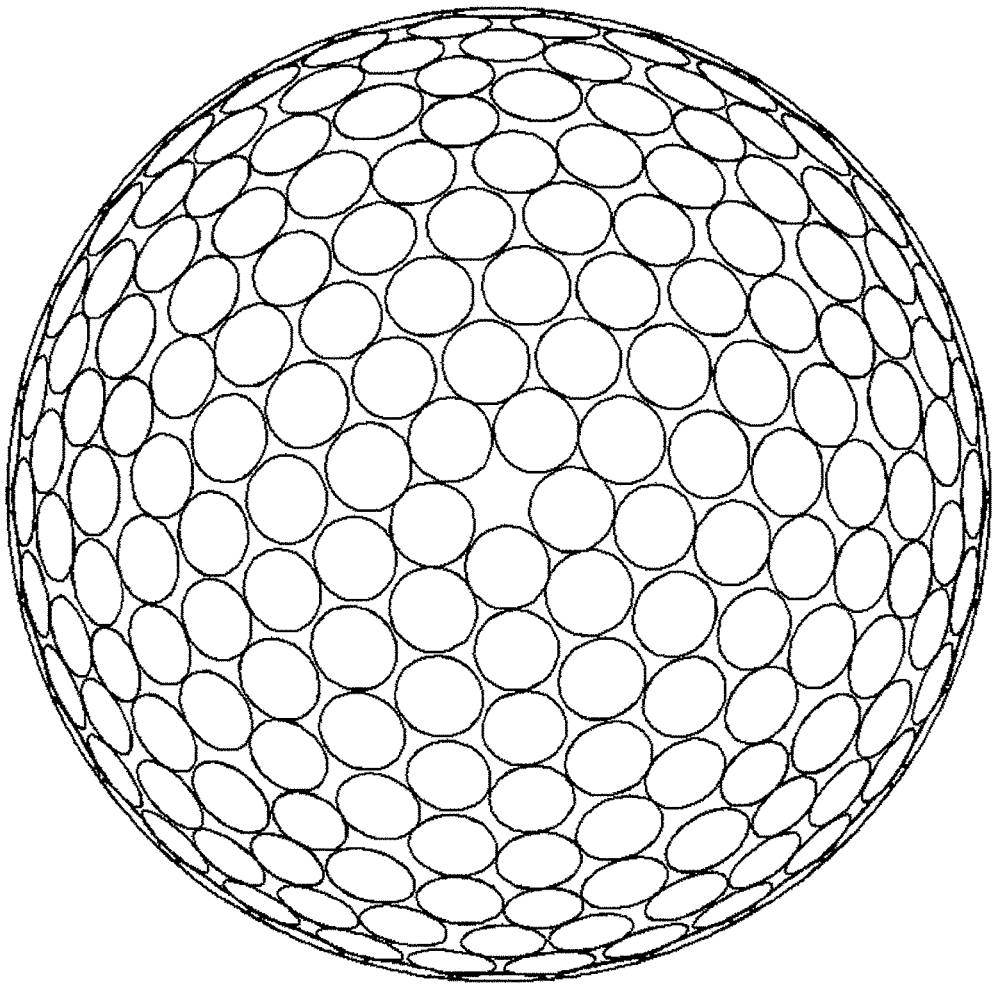
FIG. 17 is a plan view of the golf ball in FIG. 16.
Figure 18:
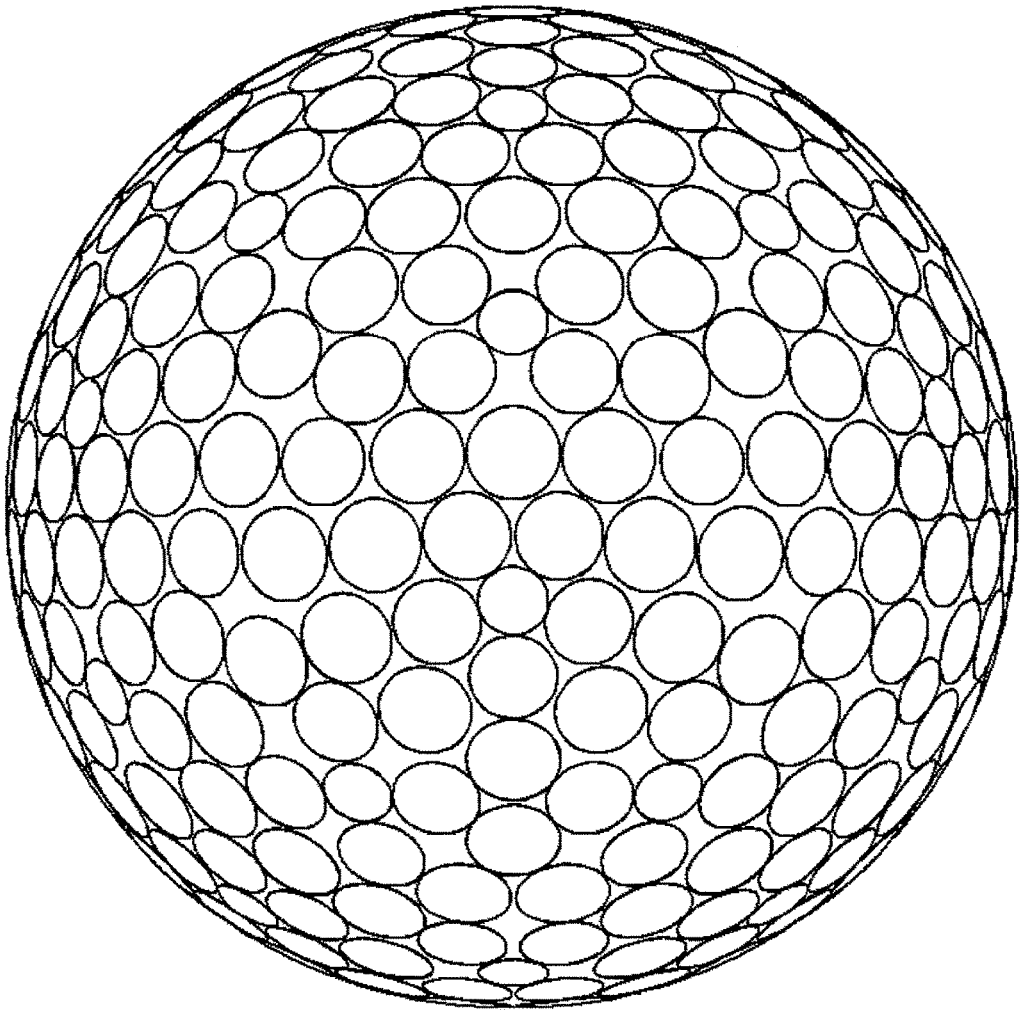
FIG. 18 is a front view of a golf ball according to Comparative Example 2.
Figure 19:
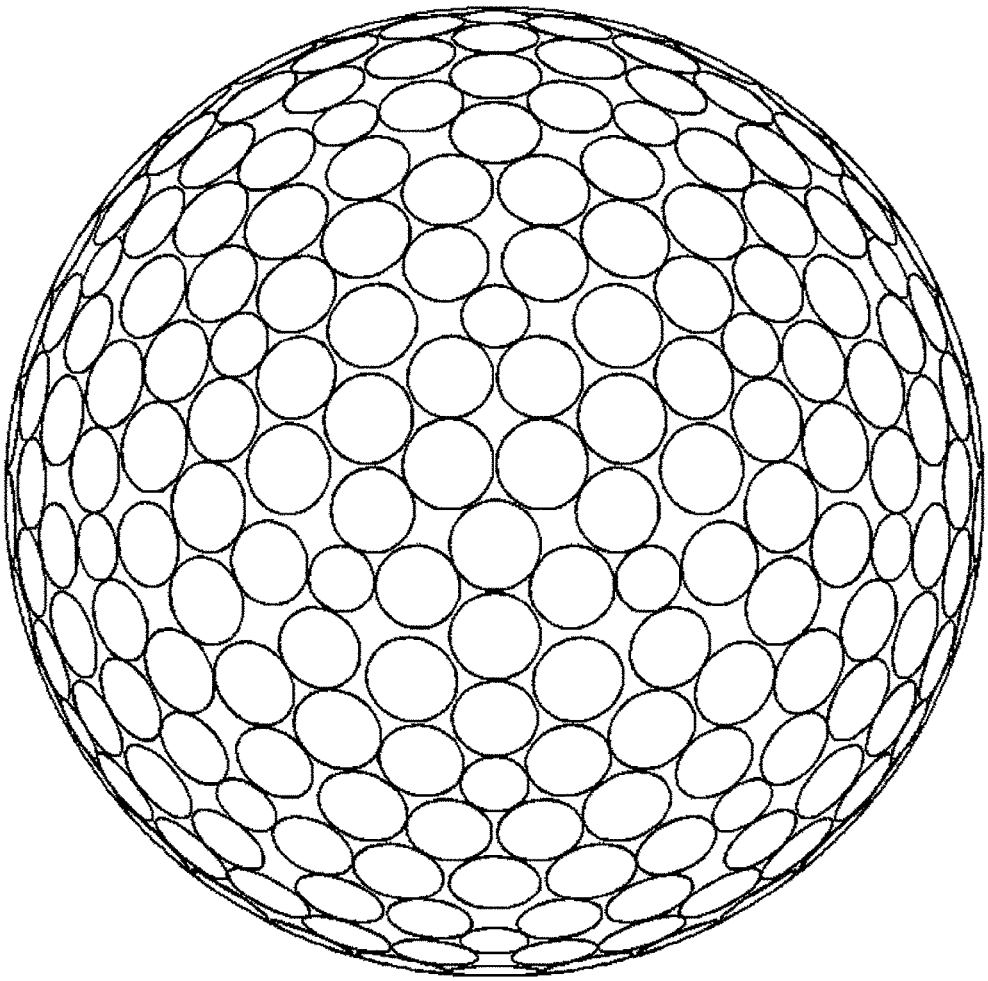
FIG. 19 is a plan view of the golf ball in FIG. 18.
Figure 20:
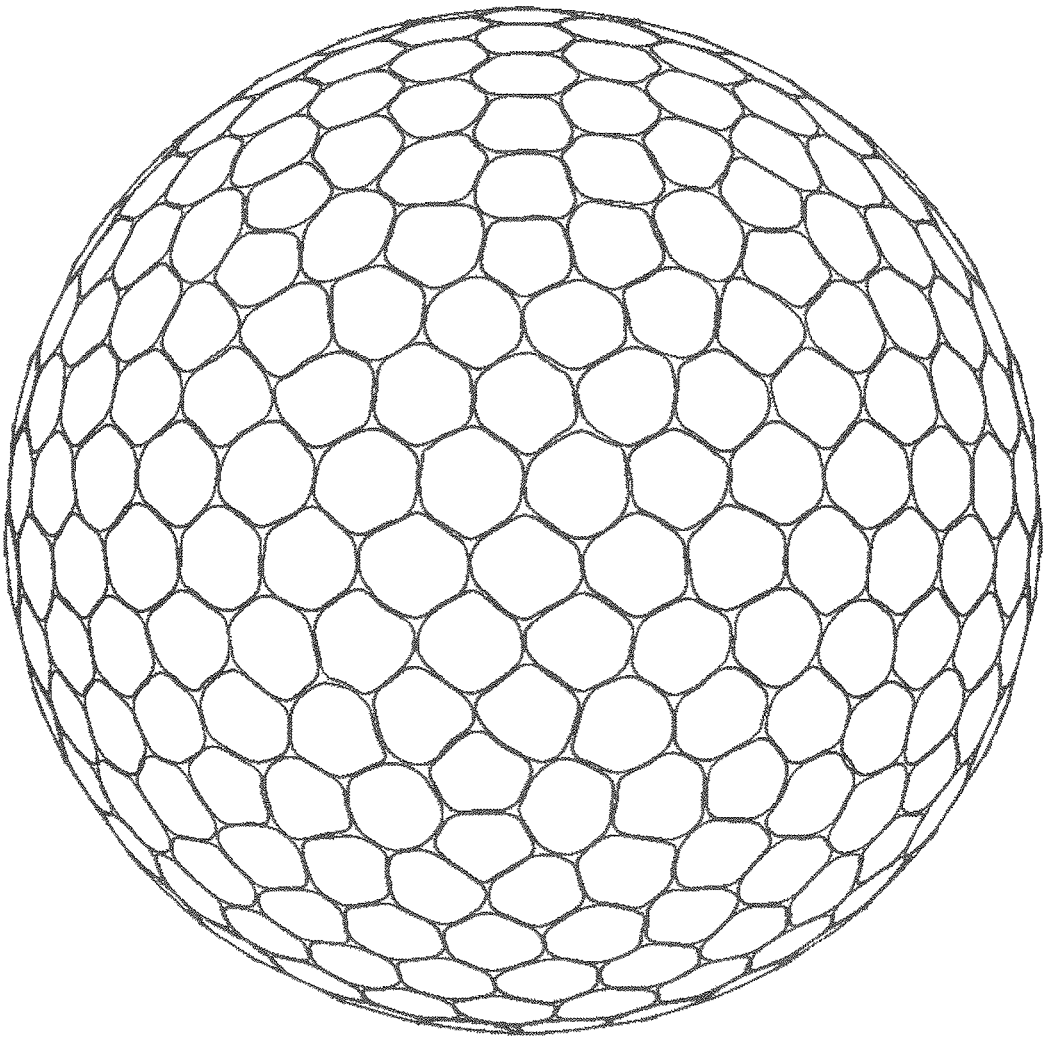
FIG. 20 is a front view of a golf ball according to Comparative Example 3.
Figure 21:
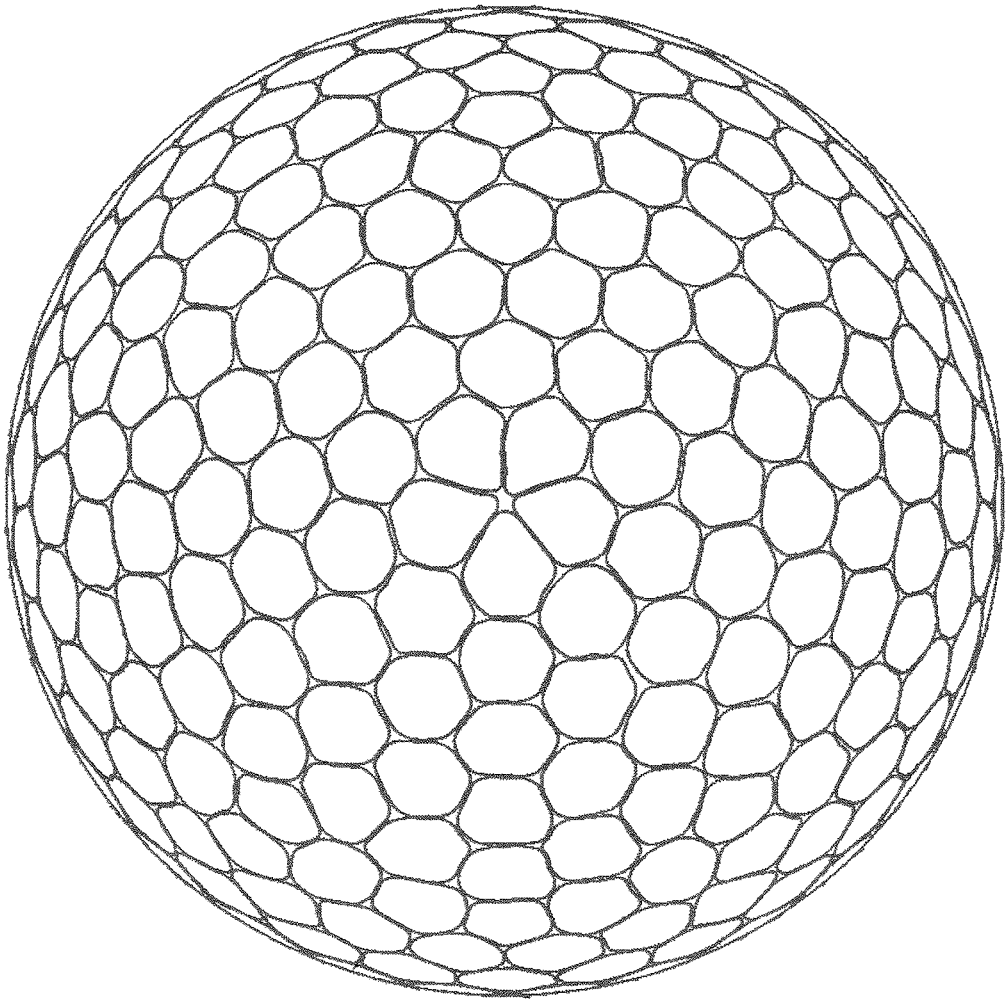
FIG. 21 is a plan view of the golf ball in FIG. 20.
Figure 22:
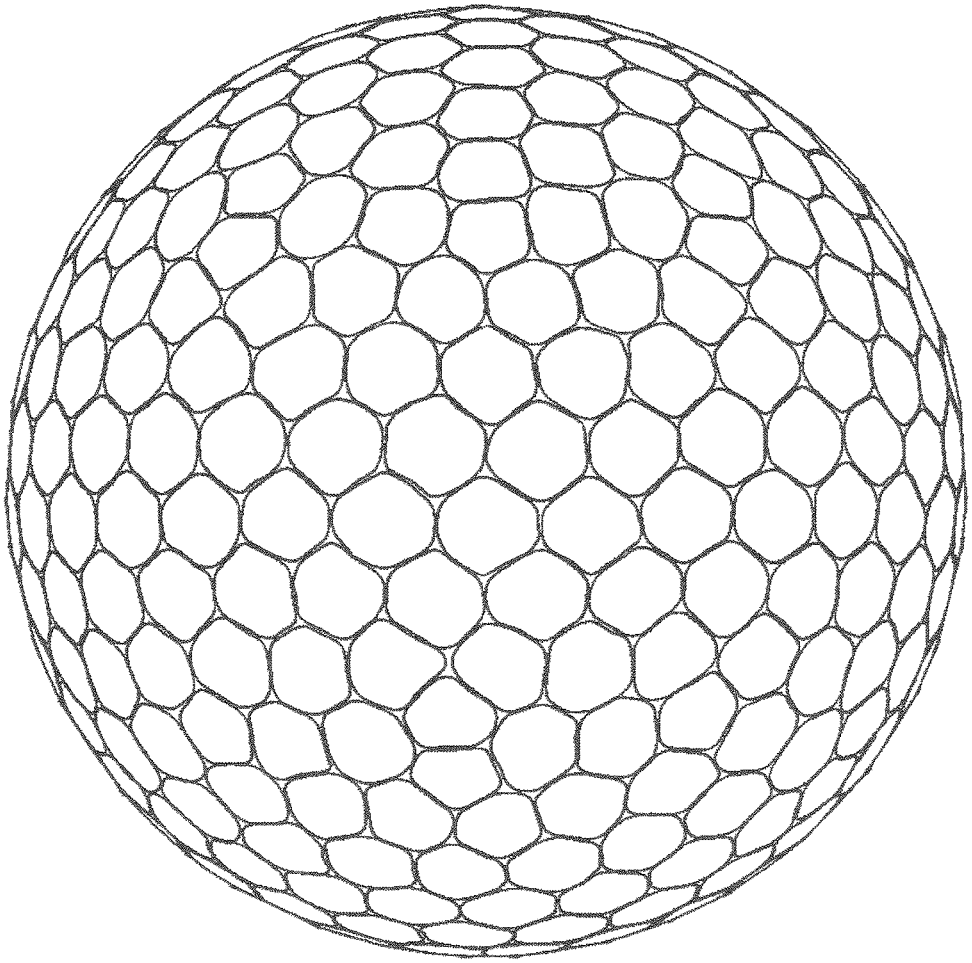
FIG. 22 is a front view of a golf ball according to Comparative Example 4.
Figure 23:
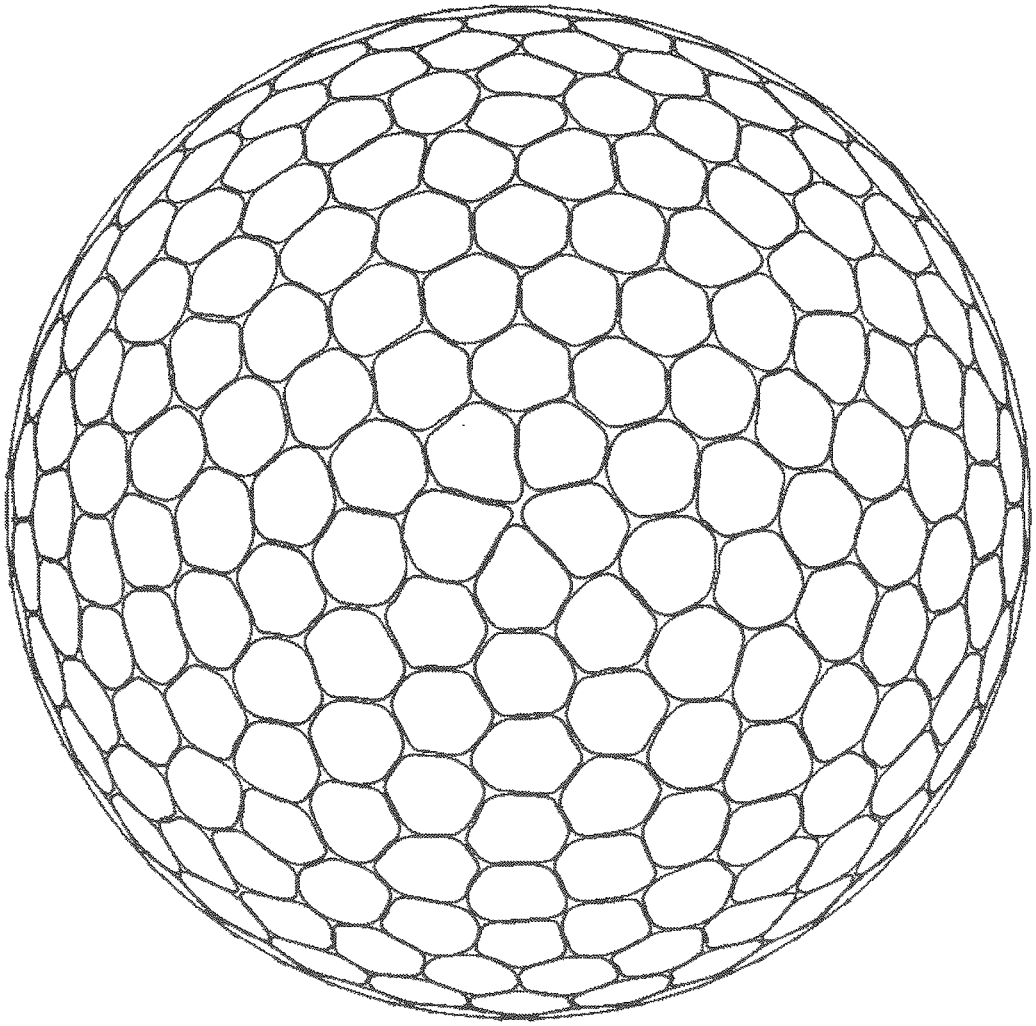
FIG. 23 is a plan view of the golf ball in FIG. 22.

| | Comp. Example 1 | Comp. Example 2 | Comp. Example 3 | Comp. Example 4 |
|---|---|---|---|---|
| Front view | FIG. 16 | FIG. 18 | FIG. 20 | FIG. 22 |
| Plan view | FIG. 17 | FIG. 19 | FIG. 21 | FIG. 23 |
| Designing process | H.D. | P.D. | H.D. V.T. | H.D. V.T. |
| Nt | 400 | 396 | 400 | 400 |
| Nu (max) | 36 | 35 | 36 | 36 |
| Nu (min) | 30 | 31 | 30 | 30 |
| Number of repeats of V.T. | — | — | 0 | 20 |
| Depth (mm) | 0.27 | 0.27 | 0.27 | 0.27 |
| Shape | Circular | Circular | Non-circular | Non-circular |
| Volume ($cm^3$) | 600 | 600 | 600 | 600 |
| So (%) | 79% | 79% | 92% | 92% |
| σ ($mm^2$) | 1.3 | 1.6 | 1.4 | 1.2 |
| Flight distance (m) | | | | |
| POP | 263.0 | 261.0 | 264.2 | 264.7 |
| PH | 261.1 | 260.5 | 262.5 | 263.1 |
| Difference | 1.9 | 0.5 | 1.7 | 1.6 |

H.D.: Hemisphere division
P.O.: Polyhedron division
V.T.: Voronoi tessellation

As shown in Tables 1 and 2, the golf ball of each Example has excellent flight distance performance and aerodynamic symmetry. From the results of evaluation, advantages of the present invention are clear.

The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball having a large number of dimples on a surface thereof, wherein a standard deviation of areas of the dimples is equal to or less than 1.7 $mm^2$, a ratio of a total area of the dimples relative to a surface area of a phantom sphere of the golf ball is equal to or greater than 80%, the dimples include a dimple having a non-circular contour, and by comparting lines obtained by projecting sides of a regular dodecahedron, which is inscribed in the phantom sphere, onto the phantom sphere, a surface of the phantom sphere can be divided into 12 units each of which meets the following mathematical formula (I):

$$-2 \leq (Nt/12) - Nu \leq 2 \quad \text{(I)},$$

where Nt represents a total number of the dimples and Nu represents a number of the dimples on one unit.

2. The golf ball according to claim 1, wherein each dimple has a contour shape different from those of any other dimples.

3. The golf ball according to claim 1, wherein a total volume of the dimples is equal to or greater than 520 $mm^3$ but equal to or less than 720 $mm^3$.

4. The golf ball according to claim 1, wherein the total number Nt is equal to or greater than 300 but equal to or less than 450.

* * * * *